US011459694B2

(12) United States Patent
Attar et al.

(10) Patent No.: US 11,459,694 B2
(45) Date of Patent: Oct. 4, 2022

(54) DOOR-IN-DOOR DESIGN

(71) Applicant: WHIRLPOOL CORPORATION, Benton Harbor, MI (US)

(72) Inventors: Mohsin M. Attar, Pune (IN); Jalindar S. Dawange, Pune (IN); Marcus R. Fischer, Stevensville, MI (US); Jyothi P. Prasad, Pune (IN); Thiyagu PS, Pune (IN); Vaibhav Upasani, Pune (IN); Bhushan Vijay Patil, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 207 days.

(21) Appl. No.: 16/899,745

(22) Filed: Jun. 12, 2020

(65) Prior Publication Data

US 2021/0047770 A1 Feb. 18, 2021

Related U.S. Application Data

(60) Provisional application No. 62/885,924, filed on Aug. 13, 2019.

(51) Int. Cl.

| | |
|---|---|
| ***D06F 39/14*** | (2006.01) |
| ***D06F 37/28*** | (2006.01) |
| ***D06F 58/04*** | (2006.01) |

(52) U.S. Cl.

CPC ..... *D06F 39/14* (2013.01); *D06F 37/28* (2013.01); *D06F 58/04* (2013.01)

(58) Field of Classification Search

CPC ..... D06F 39/14; D06F 37/28; D06F 58/04

See application file for complete search history.

(56) References Cited

U.S. PATENT DOCUMENTS

| | | | | |
|---|---|---|---|---|
| 7,954,345 | B2 | 6/2011 | Park | |
| 8,826,701 | B2 | 9/2014 | Hong et al. | |
| 9,957,656 | B2 | 5/2018 | Jo et al. | |
| 10,060,070 | B2 | 8/2018 | Jo et al. | |
| 10,100,457 | B2 | 10/2018 | Jo et al. | |
| 2008/0223085 | A1* | 9/2008 | Park | D06F 39/14 220/376 |
| 2011/0120195 | A1* | 5/2011 | Jeoung | D06F 37/28 68/139 |
| 2016/0273149 | A1* | 9/2016 | Jo | D06F 34/20 |
| 2018/0179690 | A1* | 6/2018 | Ch | D06F 37/06 |
| 2018/0340286 | A1 | 11/2018 | Kim et al. | |
| 2019/0010650 | A1 | 1/2019 | Xu et al. | |
| 2019/0071809 | A1* | 3/2019 | Chun | D06F 39/12 |

(Continued)

FOREIGN PATENT DOCUMENTS

| | | | | |
|---|---|---|---|---|
| CN | 109208276 A | 1/2019 | | |
| EP | 2141277 A1 * | 1/2010 | | D06F 37/28 |

(Continued)

*Primary Examiner* — Daniel J Rohrhoff

(74) *Attorney, Agent, or Firm* — Price Heneveld LLP

(57) ABSTRACT

A laundry appliance includes a cabinet and a tub that is disposed within the cabinet. A first door is coupled to the cabinet and is operable between open and closed positions. A second door is operably coupled to the tub. The second door is configured to move with the tub and independently of the first door in the closed position. A coupling member is at least partially disposed on the first door. The first and second doors are operably coupled by the coupling member.

15 Claims, 18 Drawing Sheets

(56) References Cited

U.S. PATENT DOCUMENTS

| | | | | |
|---|---|---|---|---|
| 2020/0157728 | A1* | 5/2020 | Bodine | D06F 37/10 |
| 2020/0332456 | A1* | 10/2020 | Yl | D06F 33/30 |

FOREIGN PATENT DOCUMENTS

| | | | |
|---|---|---|---|
| EP | 2327824 | B1 | 5/2013 |
| EP | 2141277 | B1 | 3/2014 |
| JP | 2006280401 | A | 10/2006 |
| JP | 2017074189 | A | 4/2017 |
| KR | 100447664 | B1 | 9/2004 |
| KR | 100751779 | B1 | 8/2007 |
| KR | 20100070707 | A | 6/2010 |

* cited by examiner

DOOR-IN-DOOR DESIGN

CROSS-REFERENCE TO RELATED APPLICATION

This application claims the benefit under 35 U.S.C. § 119(e) to U.S. Provisional Patent Application No. 62/885,924, filed Aug. 13, 2019, entitled "DOOR-IN-DOOR DESIGN," which is incorporated herein by reference in its entirety.

BACKGROUND OF THE DISCLOSURE

The present disclosure generally relates to a laundry appliance, and more specifically, to a door-in-door design for a laundry appliance.

SUMMARY OF THE DISCLOSURE

According to one aspect of the present disclosure, a laundry appliance includes a cabinet and a tub that is disposed within the cabinet. A first door is coupled to the cabinet and is operable between open and closed positions. A second door is operably coupled to the tub. The second door is configured to move with the tub and independently of the first door in the closed position. A coupling member is at least partially disposed on the first door. The first and second doors are operably coupled by the coupling member.

According to another aspect of the present disclosure, a laundry appliance includes a cabinet. A tub is disposed within the cabinet. A first door is operably coupled to the cabinet. A second door is operably coupled to the tub and is selectively coupled to the first door. The second door is configured to move independently of the first door and in unison with the tub in a closed position. A coupling member is coupled to the first door and is selectively coupled to the second door. The coupling member includes a retention member that is coupled to the first door, a hook that is selectively coupled to the second door, and a detained end that is coupled to the hook and is operably coupled to the retention member.

According to yet another aspect of the present disclosure, a laundry appliance includes a cabinet. A tub is disposed within the cabinet. A first door is operably coupled to the cabinet. A second door is operably coupled to the tub and defines an inner door socket. A coupling member is coupled to the first door and is selectively coupled to the second door. The coupling member includes a body that is coupled to the first door, a connector that is coupled to the body and has a second socket, and a ball assembly that is operably coupled to the connector and the second door via the first socket and the second socket, respectively.

These and other features, advantages, and objects of the present disclosure will be further understood and appreciated by those skilled in the art by reference to the following specification, claims, and appended drawings.

Figure 1:
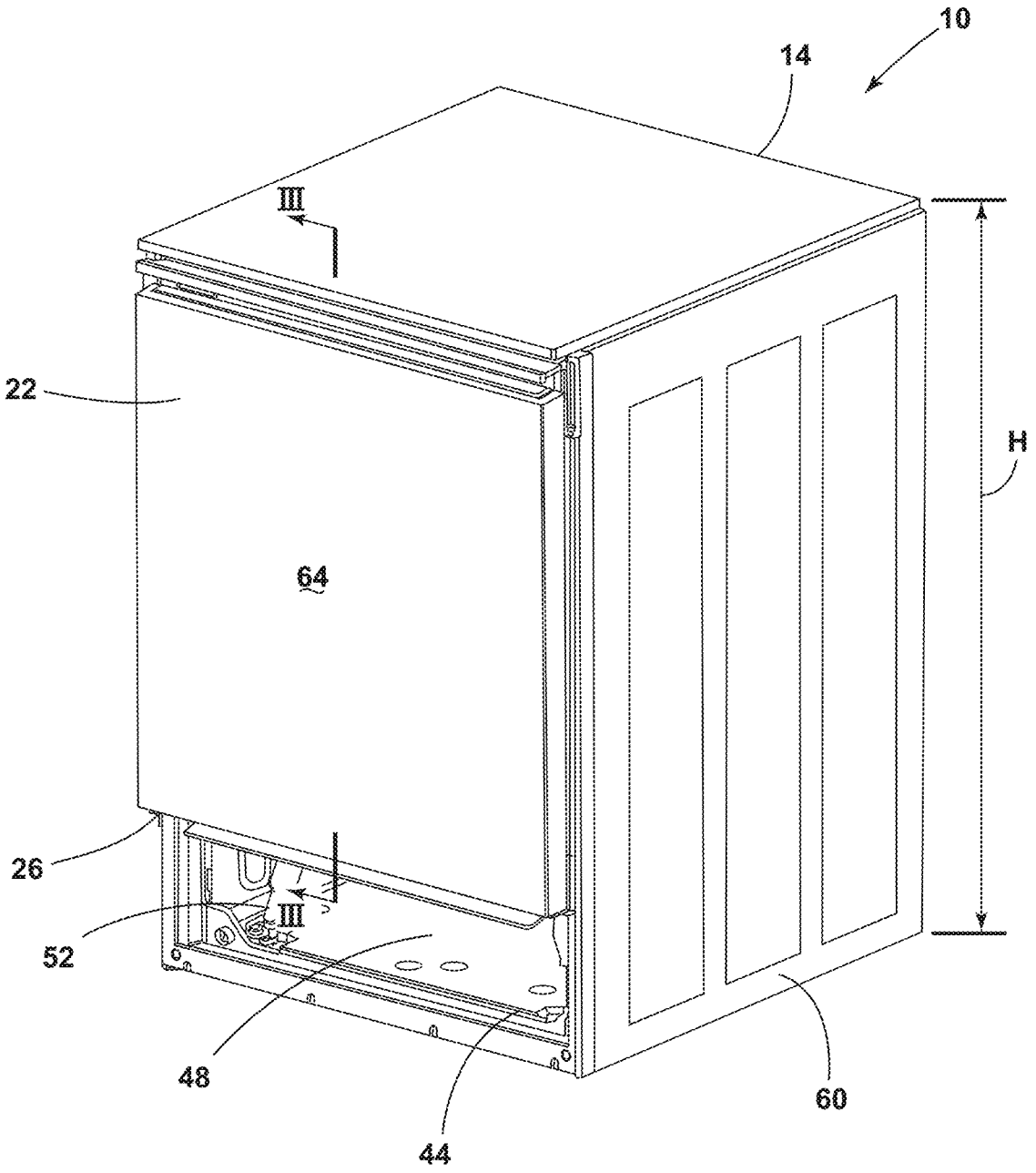
FIG. 1 is a front perspective of an appliance of the present disclosure with a door in a closed position.

The components in the figures are not necessarily to scale, emphasis instead being placed upon illustrating the principles described herein.

DETAILED DESCRIPTION

The present illustrated embodiments reside primarily in combinations of apparatus components related to a door-in-door design. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-21, reference numeral 10 generally designates a laundry appliance that includes a cabinet 14 and a tub 18 disposed within the cabinet 14. A first door 22 is coupled to the cabinet 14 and is operable between an open position 24 and a closed position 26. A second door 30 is operably coupled to the tub 18. The second door 30 is configured to move with the tub 18 and independently of the first door 22 in the closed position 26. A coupling member 34 is at least partially disposed on the first door 22 and selectively coupled to the second door 30. The first and second doors 22, 30 are operably and selectively coupled to one another by the coupling member 34. As described and referred to herein, the first door 22 corresponds to an outer door 22 and the second door 30 corresponds to an inner door 30.

Figure 2:
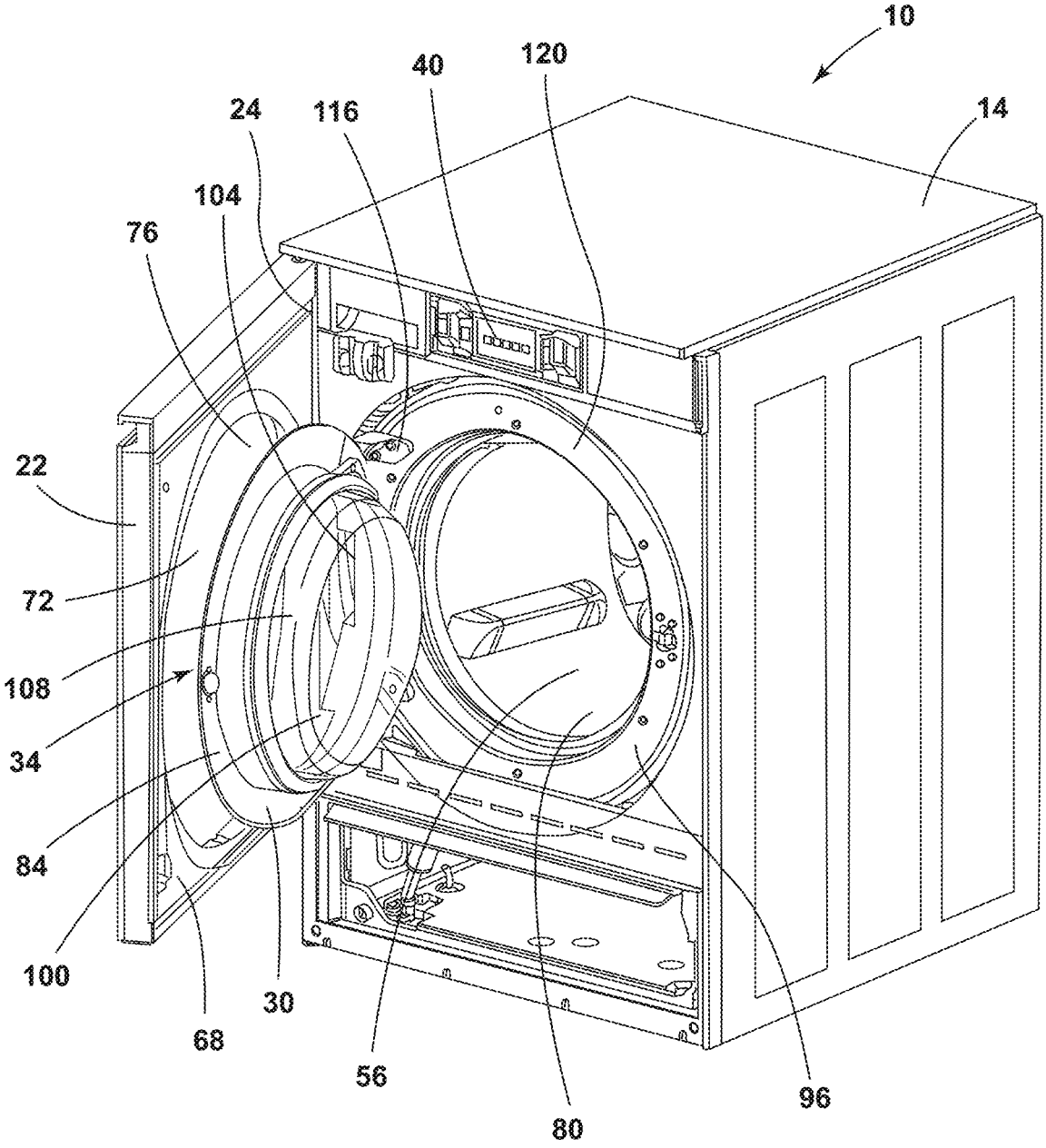
FIG. 2 is a front perspective of the appliance of FIG. 1 with the door in an open position.

Referring to FIGS. 1 and 2, the laundry appliance 10 is depicted as a front-load configuration. However, it is also contemplated that the laundry appliance 10 may also be a top-load configuration. It is further contemplated that the construction described herein may be applicable for a washer, a dryer, or a combination laundry appliance. A user interface 40 can be coupled to the cabinet 14 to select and control the various cycles of the laundry appliance 10. In addition, a machine compartment 44 may be adjacent to the outer door 22 and is illustrated within a cavity 48 below the outer door 22. A suspension system 52 may be accessed via the machine compartment 44 and is generally configured to stabilize and support the rotational movement of the tub 18 (FIG. 3) and a drum 56 of the laundry appliance 10.

As illustrated in FIG. 2, the cabinet 14 of the laundry appliance 10 includes a cabinet shell 60 and the outer door 22. The outer door 22 is hingedly coupled to the cabinet shell 60 and may extend at least partially along a height H of the cabinet 14. For example, the outer door 22 is illustrated in FIG. 1 as partially extending the height H of the cabinet 14, such that the machine compartment 44 is covered by a separate panel. In addition, the outer door 22 may also extend the entire height Hof the cabinet 14, such that the outer door 22 extends over the separate panel concealing the machine compartment 44 to conceal the machine compartment 44 in the closed position 26.

The outer door 22 may be formed from various materials in order to provide an aesthetically appealing outward appearance for the user. An exterior surface 64 of the outer door 22 may be formed from stainless steel or other metallic panel, ceramic, glass, wood paneling, or other aesthetic coverings known in the art. An interior surface 68 of the outer door 22 may include a recessed portion 72, which may have similar dimensions as the inner door 30. By way of example, not limitation, the inner door 30 can be configured to generally be disposed in the recessed portion 72 of the outer door 22 when the outer and inner doors 22, 30 are in the closed position 26. In addition, a gap 76 may be defined between the outer and inner doors 22, 30 so that the inner door 30 may articulate, or be articulated, in at least a forward and a rearward direction. As described in more detail below, the coupling member 34 is at least partially coupled to the interior surface 68 of the outer door 22, such that the coupling member 34 may be disposed on the recessed portion 72 of the outer door 22.

Referring again to FIGS. 2 and 3, the inner door 30 is located interior to the outer door 22 and is selectively coupled to the interior surface 68 of the outer door 22 via the coupling member 34 to define a translational movement. While the outer door 22 may be generally rectangular, corresponding with the general shape of the laundry appliance 10, it is generally contemplated that the outer door 22 may be any shape that is useful for defining the closed position 26. Comparatively, the inner door 30 is typically shaped to correspond with the typical shape and size of an opening 80 defined by the tub 18 and the cabinet 14. As depicted, and as is typical with front-load laundry appliances, the opening 80 and the inner door 30 are generally circular. Accordingly, a frame 84 of the inner door 30 may be generally circular to correspond with the generally circular opening 80. The frame 84 includes an outer frame 86 adjacent to the outer door 22 in the closed position 26 and an inner frame 88 adjacent to a tub ring 96 of the laundry appliance 10. Typically, the frame 84 is formed from a rigid, metallic material. However, it is also contemplated that the frame 84 may be formed from other materials known in the art, such as plastics.

A barrier layer 100 is positioned between the outer and inner frames 86, 88 of the inner door 30 to block materials from exiting the tub 18 and the drum 56 of the laundry appliance 10. For example, during a wash cycle, clothing is typically saturated with a combination of water and laundry chemistry, typically detergent, and during the wash cycle the clothes are rotated, spun, and generally agitated, such that, without the barrier layer 100, clothing may exit the drum 56. As illustrated, the barrier layer 100 has an inner wall 104 inwardly extending towards the drum 56 from a side rim 108 of the barrier layer 100. The barrier layer 100 may generally have a fishbowl construction. It is also contemplated that the barrier layer 100 may include a deflector 112 to help minimize water leakage from the tub 18 and the drum 56, such that the deflector 112 typically redirects water inward toward the tub 18 and the drum 56.

In general, washtub doors on traditional laundry appliances are secured only to the outer body of the traditional laundry appliance. Accordingly, the washtub door alone may be insufficient to seal the washtub. Therefore, traditional laundry appliances typically require a bellows to seal the washtub relative to the washtub door. Over time, the bellows may accrue detergent and lint build-up, which may, in turn, require additional maintenance and cleaning of the bellows. Moreover, traditional front-load laundry appliances may require that the washtub door has a water return integrated into the washtub door to prevent water collection in and on the bellows.

Figure 3:
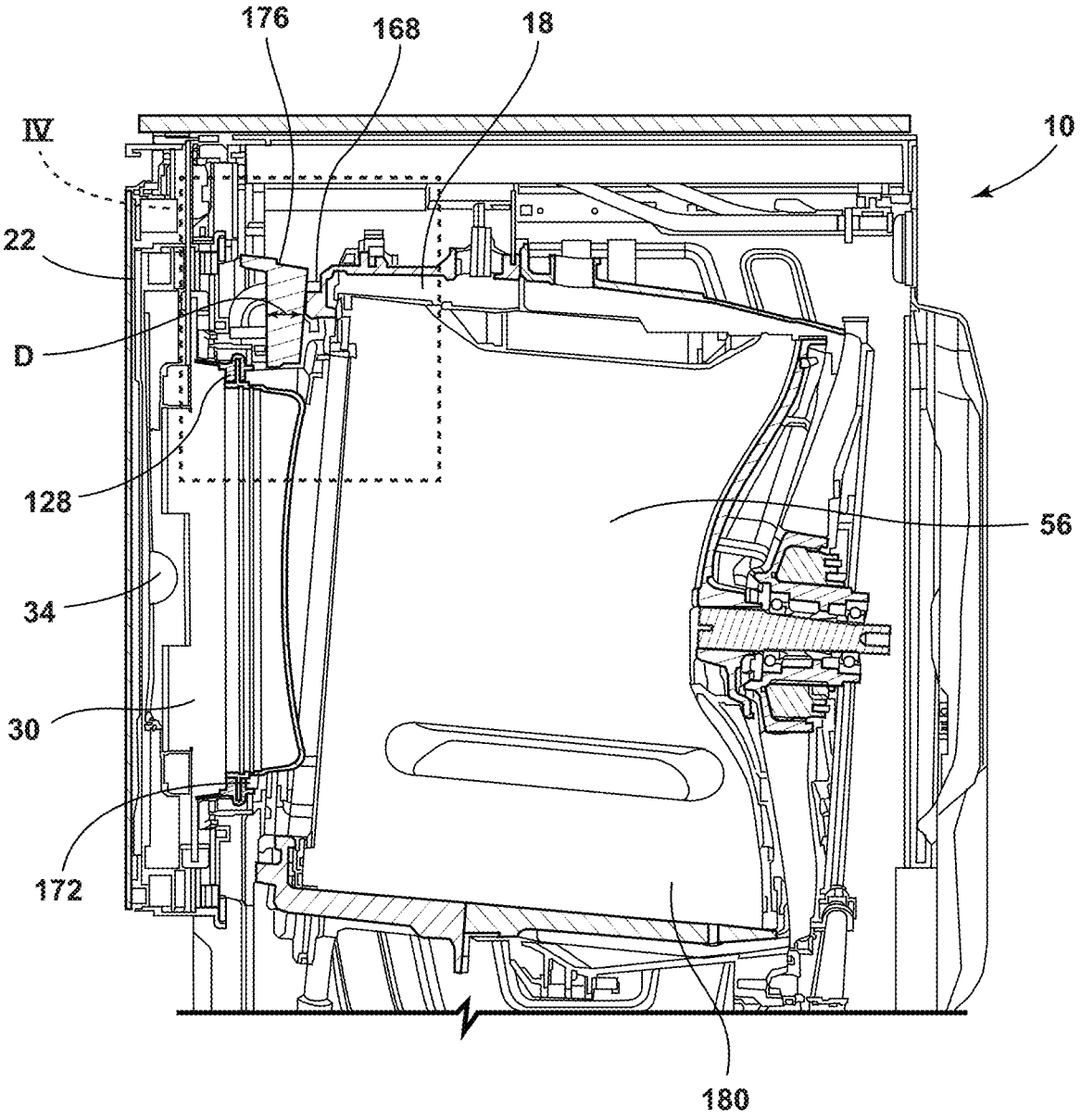
FIG. 3 is a cross-sectional view of the appliance of FIG. 1 taken along lines III-Ill.

As illustrated in FIGS. 2 and 3, the inner door 30 of the laundry appliance 10 of the present disclosure is coupled directly to the tub 18 thus eliminating the need for a bellows.

Accordingly, as mentioned above, the barrier layer 100 may have the inner wall 104 inwardly extending toward the drum 56. The inner wall 104 and the frame 84 of the inner door 30 at least partially defines a seal between the inner door 30, the tub 18 such that water leakage is sufficiently minimized, described in further detail below. The inner door 30 may be hingedly coupled to the tub ring 96, such that the inner door 30 may oscillate and move with the various vibrations and articulations of the tub 18 during a laundry cycle. The inner door 30 is coupled to the tub ring 96 via hinges 116 secured to a face 120 of the tub ring 96. Accordingly, the tub 18 and the inner door 30 move as a unit to accommodate the movements during the laundry cycle. In addition, the drum 56 and the rotational axis of the drum 56 moves in unison with the tub 18 and the inner door 30. At the same time, the drum 56 rotationally operates within the sealed chamber defined by the inner door 30 and the tub 18. In addition, a locking member 124 is disposed on the face 120 of the tub ring 96 to secure the inner door 30 to the tub ring 96.

Figure 4:
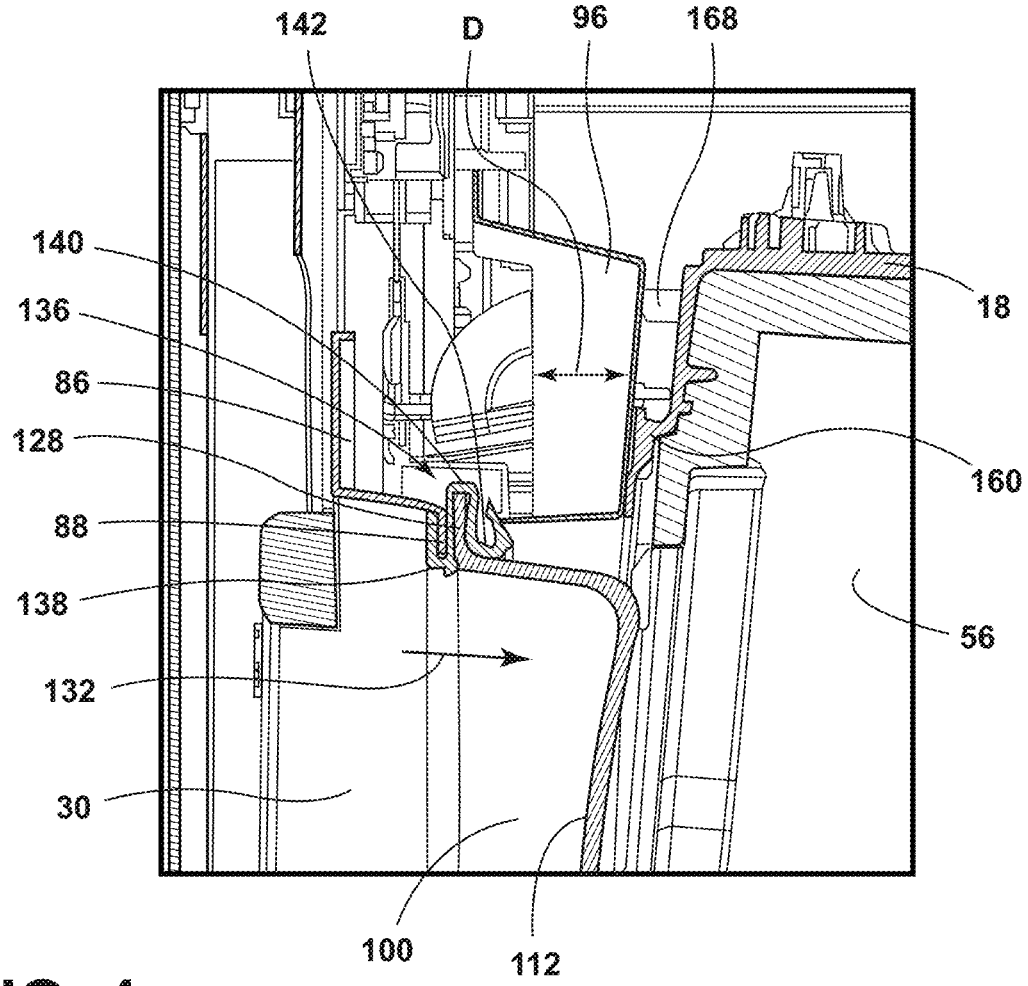
FIG. 4 is an enlarged cross-sectional view of the appliance of FIG. 3 taken at area IV.
Figure 5:
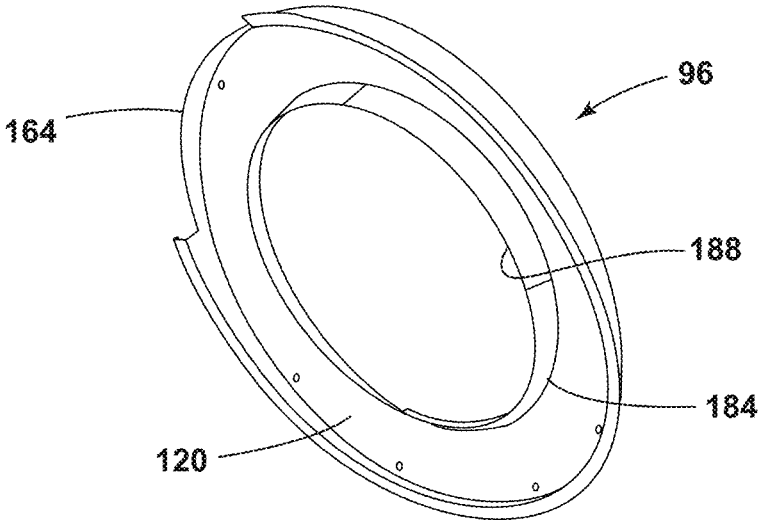
FIG. 5 is a front perspective view of a tub ring of the present disclosure.
Figure 6:
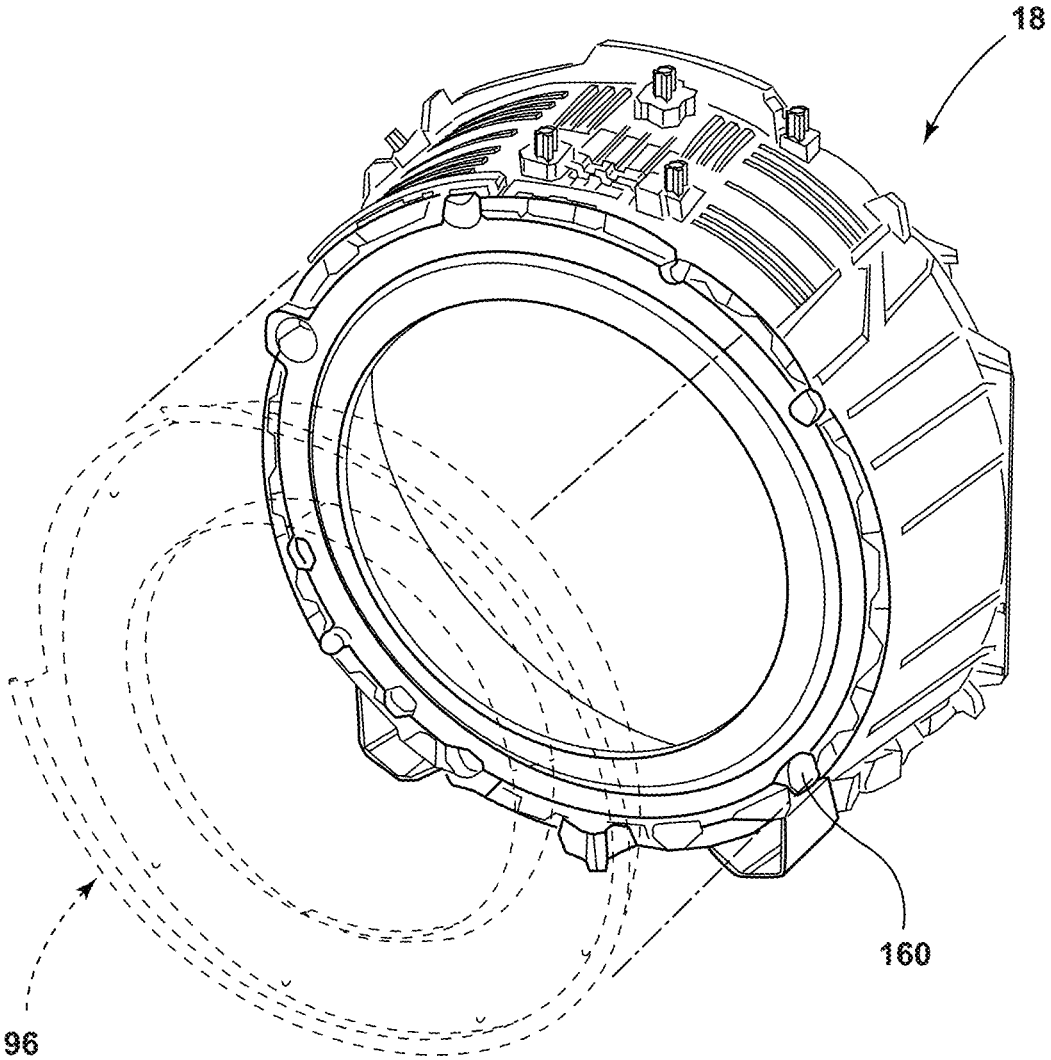
FIG. 6 is a front perspective view of a tub of the present disclosure.

With further reference to FIGS. 2-4, the seal formed by the inner door 30 with the tub 18 via the tub ring 96 is achieved using a sealing member 128 disposed around the barrier layer 100 of the inner door 30. The sealing member 128 extends around the frame 84 of the inner door 30 to seal the inner door 30. Typically, the sealing member 128 may be formed of an elastomeric material such as, by way of example, not limitation, rubber, which allows the sealing member 128 to be flexible relative to the frame 84 and the tub ring 96. A sealing force 132 can be applied to the sealing member 128 with minimal risk of damaging the sealing member 128 due to its general flexibility and elasticity. Additionally, to prevent water leakage, the sealing member 128 may at least partially suction to the tub ring 96 to further define the seal between the frame 84 of the inner door 30 and the tub ring 96. The sealing member 128 may have a series of folds 136 that act as receptacles configured to receive the frame 84 and the barrier layer 100 in order to properly place the sealing member 128 relative to the frame 84, the barrier layer 100, and the tub ring 96. For example, a first fold 138 may retain the inner frame 88, a second fold 140 may retain the barrier layer 100, and a third fold 142 may partially retain the tub ring 96.

Referring again to FIGS. 3-6, the tub ring 96 is coupled to bosses 160 on the tub 18 in place of the use of bellows, as discussed above. The tub ring 96 is typically more compact relative to the conventional bellows, such that the tub ring 96 may help increase the size of the tub 18 and the drum 56. This, in turn increases the capacity within the drum 56. As illustrated, the tub ring 96 includes a circular rim 164 that extends away from the tub 18 and toward the outer and inner doors 22, 30. The circular rim 164 spans a space 168 between the tub 18 and the sealing member 128 of the inner door 30 further providing a sealing interface 172 between the tub 18 and the inner door 30. Stated differently, the sealing member 128 disposed around the inner door 30 interfaces with the tub ring 96 to define the sealing interface 172.

As discussed herein, it is generally contemplated that the tub 18 and the drum 56 may be at least partially angled. Thus, the tub ring 96 can be formed such that the circular rim 164 extends further at a first portion 176 of the tub ring 96 to span a distance D between the angled tub 18 and the generally vertical inner door 30 to define an angled orientation 180. Accordingly, the tub ring 96 is generally aligned with the orientation of the inner door 30 so the sealing interface 172 is secured to account for the angled orientation 180 of the tub 18. In this manner, the tub ring 96 accommodates and seals the angular space defined between the angled tub 18 and the generally vertical inner door 30.

As shown in FIG. 4, the tub 18 surrounds the drum 56 and includes the bosses 160 outwardly extending from a perimeter 184 of the tub 18. The tub ring 96 couples to the bosses 160, which secure the tub 18 to the tub ring 96. In addition, an inner flange 188 of the tub ring 96 may inwardly extend relative to the tub 18, such that the inner flange 188 extends toward the drum 56. The inner flange 188 may provide additional fluid directing functions by fitting against the tub 18 and sealing with the sealing member 128 of the inner door 30 upon closure of the inner door 30 to direct moisture and fluid toward the drum 56.

Figure 7:
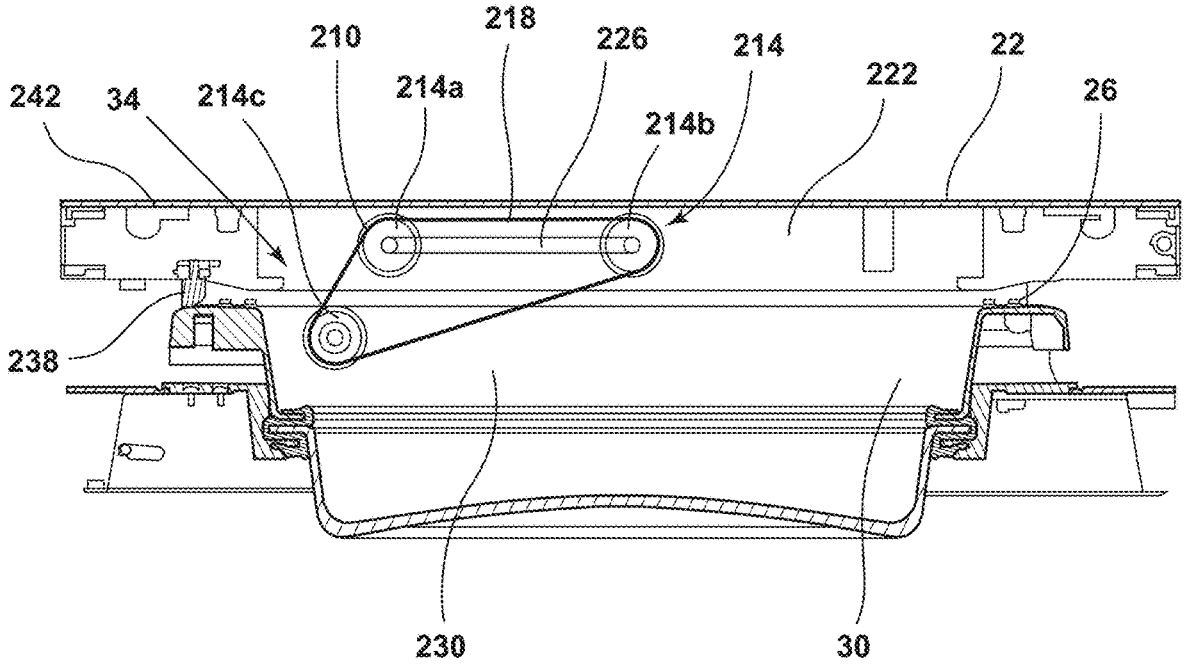
FIG. 7 is a top cross-sectional view of the appliance of FIG. 1 with a coupling member of the present disclosure.
Figure 8:
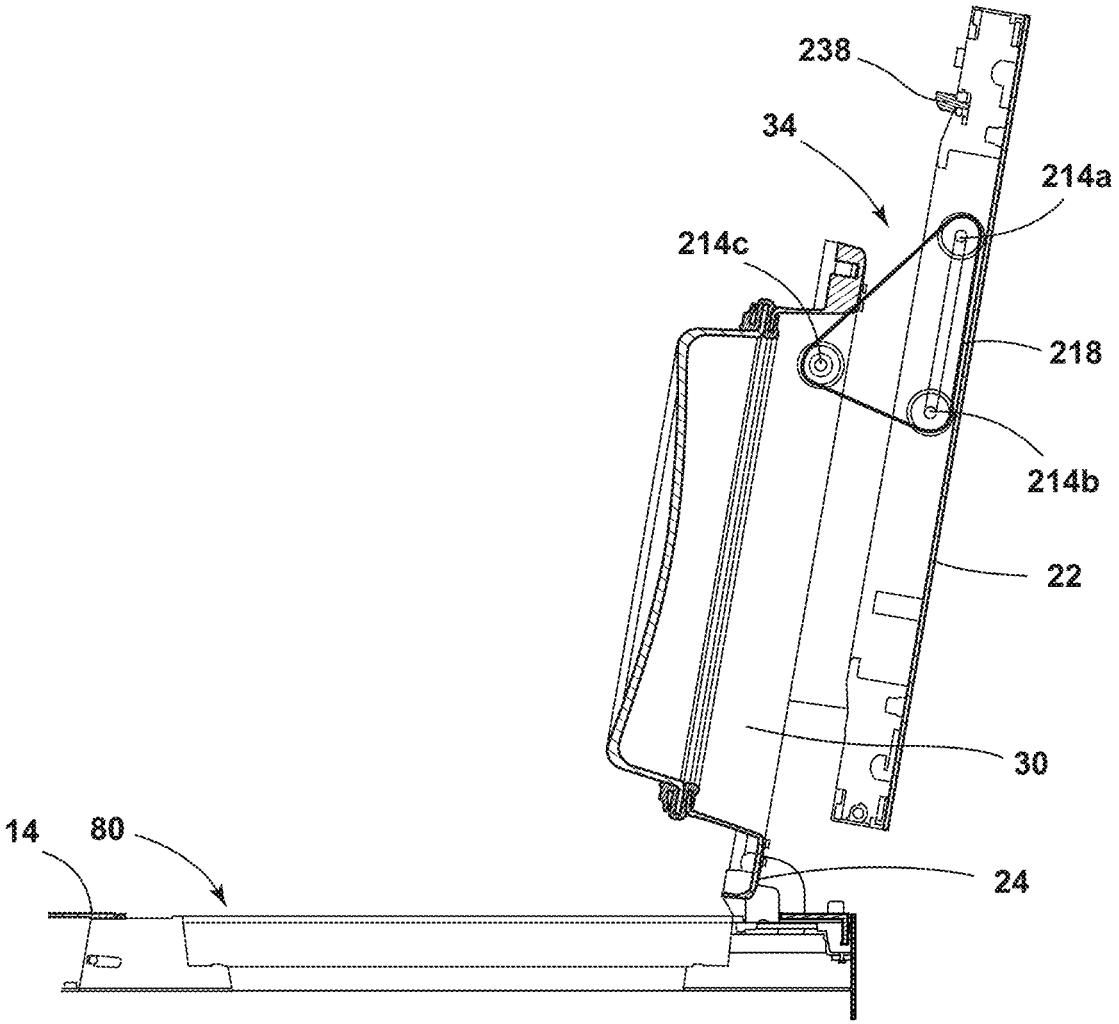
FIG. 8 is a top cross-sectional view of the appliance with the first door operatively coupled to the second door via the coupling member of FIG. 7.
Figure 9:
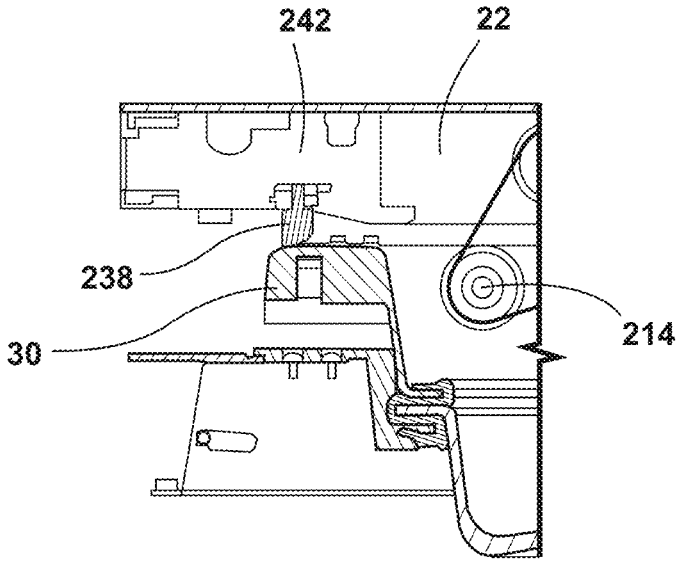
FIG. 9 is an enlarged top cross-sectional view of the appliance of FIG. 7 with a stopper member.
Figure 10:
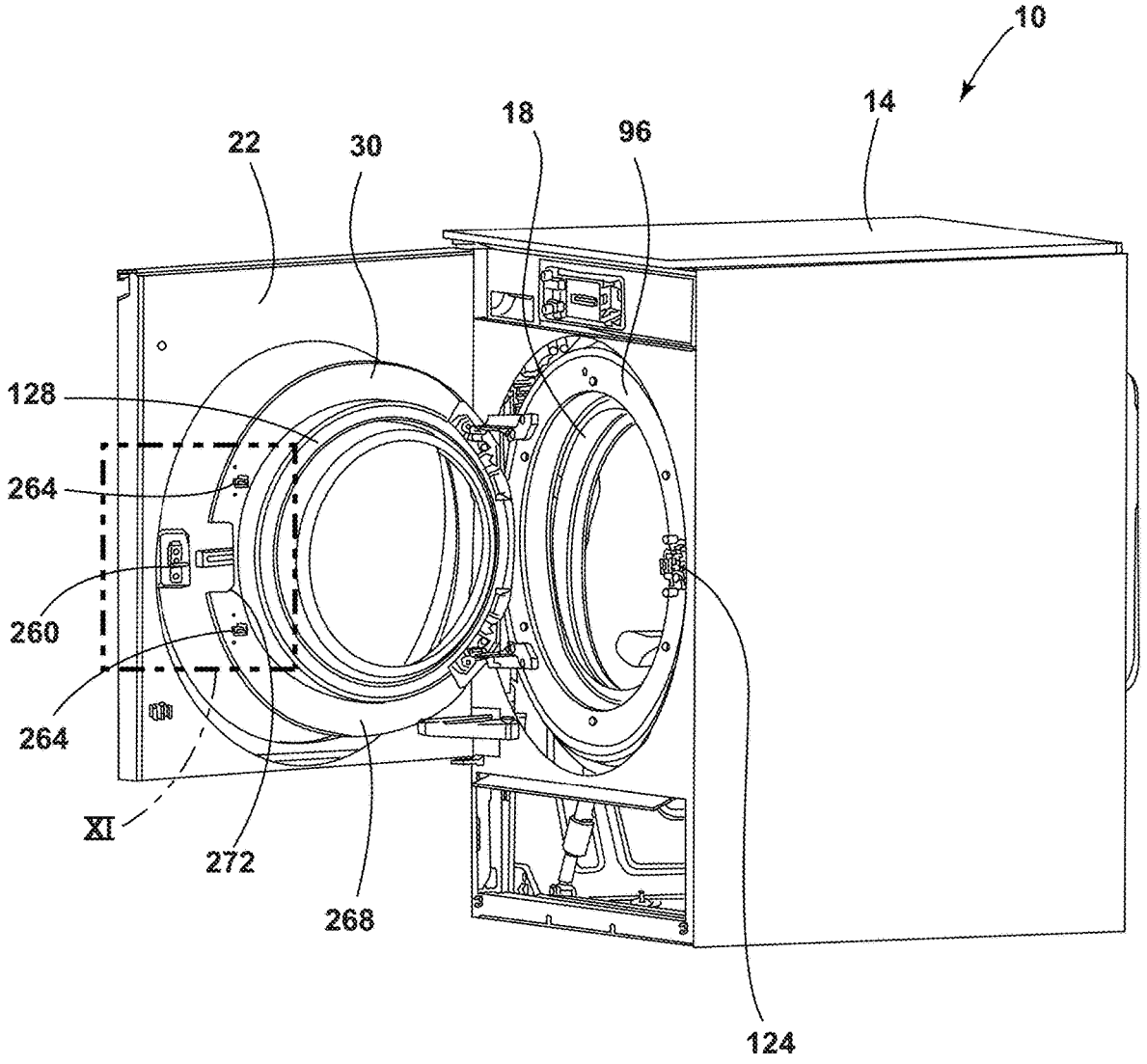
FIG. 10 is a side perspective view of an appliance of the present disclosure with a first door and a second door in an open position.
Figure 11:
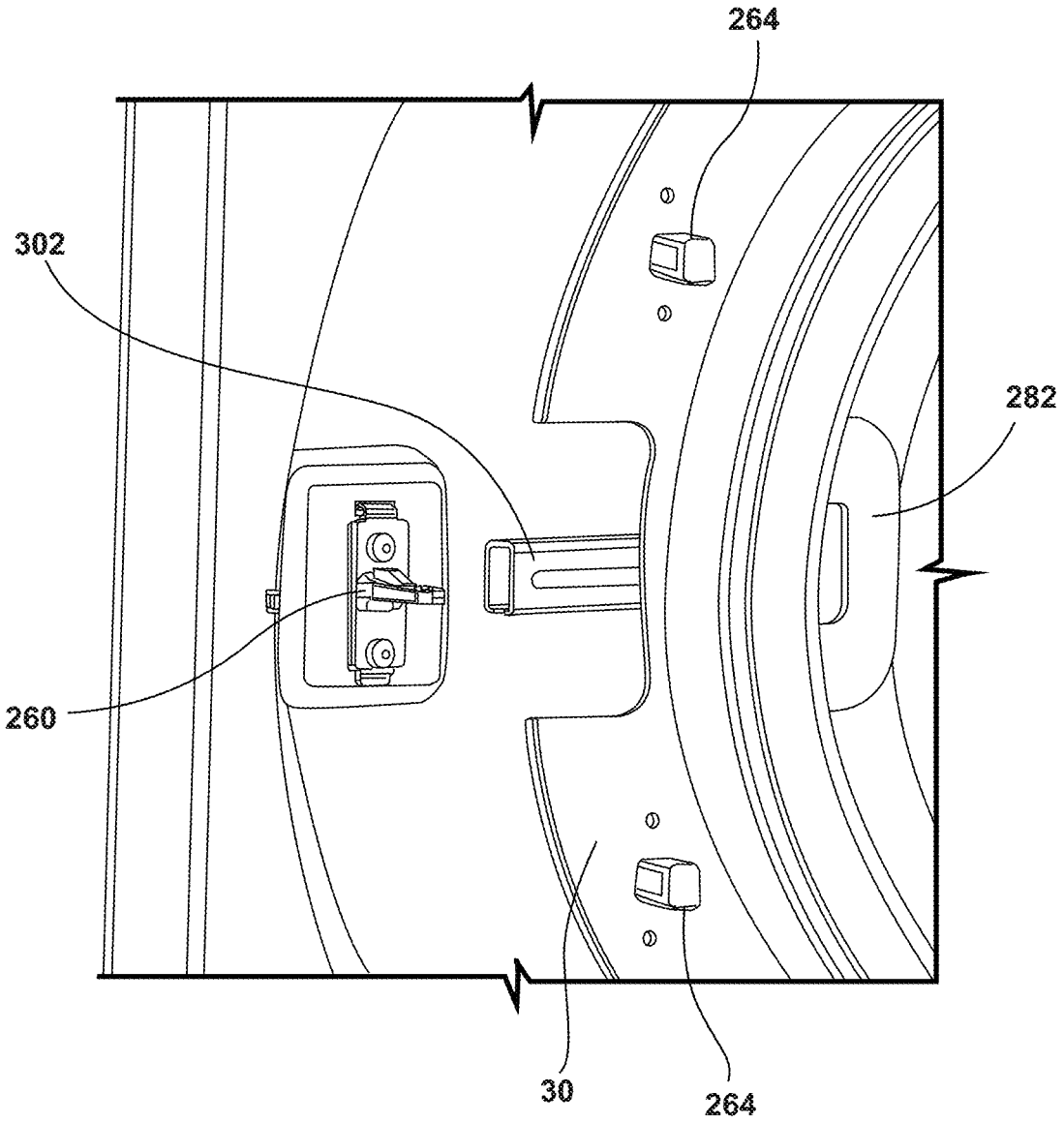
FIG. 11 is an enlarged view of a fastener and magnets of the first and second doors of the appliance of FIG. 10 taken at area XI.
Figure 12:
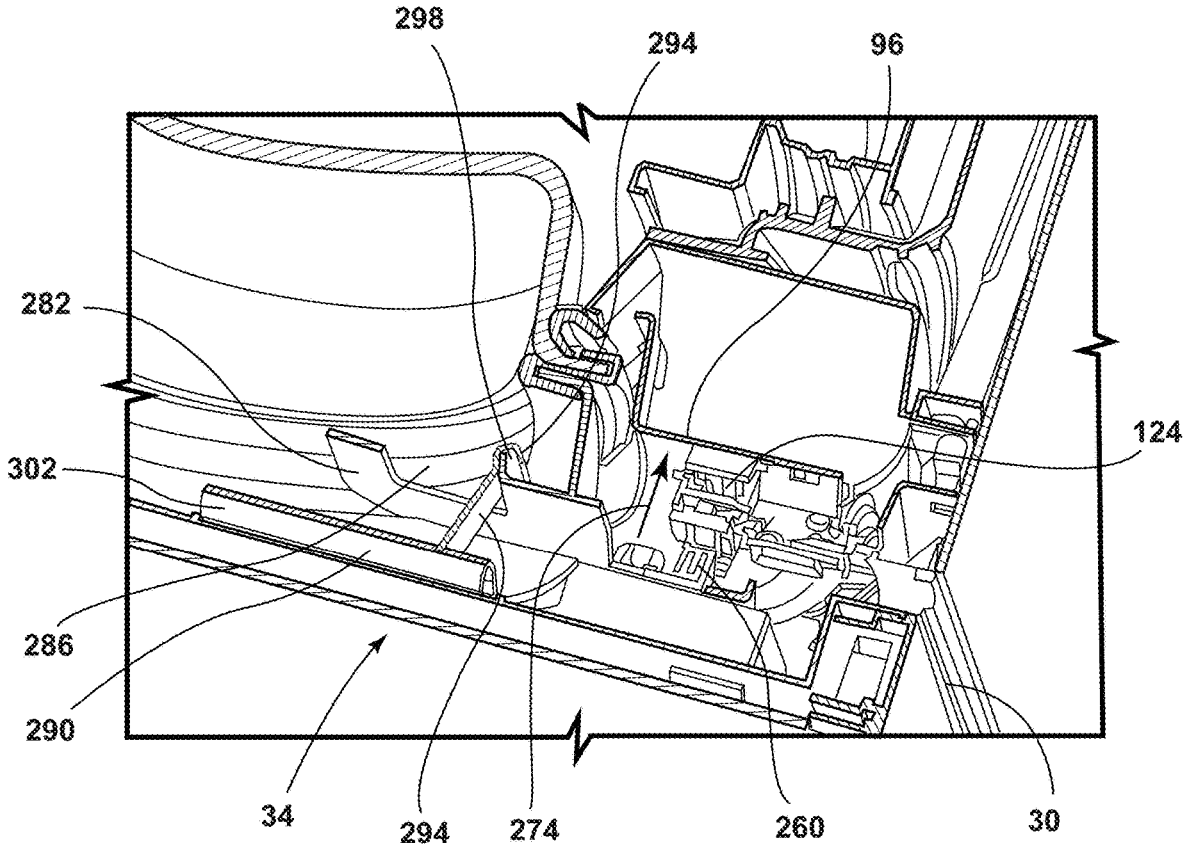
FIG. 12 is a top cross-sectional perspective view of a coupling member and a fastener of FIG. 11 in a closed position.

Referring now to FIGS. 7-9, the outer and inner doors 22, 30 are operably coupled by the coupling member 34, which is illustrated as a pulley assembly 210. The pulley assembly 210 includes a plurality of pulleys 214*a-c* and a linkage 218, illustrated as a belt. A first pulley 214*a* and a second pulley 214*b* are coupled to the outer door 22 along a perimeter edge 222 of the outer door 22 and are further coupled together by a crossbar 226. Moreover, the first and second pulleys 214*a*, 214*b* operate across the perimeter edge 222 during the opening and closing of the outer door 22. This operational movement can be used to maintain a tension within the linkage 218 during operation of the outer and inner doors 22, 30. A third pulley 214*c* is coupled to the inner door 30 along an outer perimeter 230 of the inner door 30 at a position proximate to the perimeter edge 222 of the outer door 22. The pulley assembly 210 translates the outer and inner doors 22, 30 simultaneously between the open position 24 and the closed position 26. The third pulley 214*c* translates relative to the first and second pulleys 214*a*, 214*b* as the inner and outer doors 30, 22 operate between the closed position 26 and the open position 24. This operating relationship is described in further detail below.

The linkage 218 is positioned around the first, second, and third pulleys 214*a*-214*c*, such that the linkage 218 transitions through various positions to form a generally triangular shape as the outer and inner doors 22, 30 are transitioned between the closed position 26 and the open position 24. The linkage 218 may be a generally elastomeric material that may allow the linkage 218 to stretch and flex with the various articulations of the outer and inner doors 22, 30. Additionally or alternatively, the linkage 218 may generally be inelastic, such that as the outer door 22 transitions from the closed position 26 to the open position 24, the linkage 218 may pull on the third pulley 214*c* to simultaneously open the inner door 30.

The linkage 218 can exist in a general state of tension, such that the linkage 218 may be taut between each of the first, second, and third pulleys 214*a*-214*c* when in the open position 24. Although the linkage 218 may be generally inelastic to define a fixed perimeter, the linkage 218 is sufficiently flexible to accommodate the movement of the outer and inner doors 22, 30. In certain aspects of the device, the first and second pulleys 214*a* and 214*b* can be biased away from one another. This biasing relationship can maintain a tension within the linkage 218 as the outer and inner doors 22, 30 operate between the open and closed positions #,#. It is also contemplated that the linkage 218 may generally disconnect from the third pulley 214*c* when the outer and inner doors 22, 30 are in the closed position 26 as the inner door 30 may rotate in conjunction with the tub 18.

As depicted in FIGS. 7 and 8, the third pulley 214*c* is closest to the first pulley 214*a* in the closed position 26, whereas, in the open position 24, the third pulley 214*c* is typically closest to the second pulley 214*b*. The first and second pulleys 214*a*, 214*b* typically slide along the interior surface 68 of the outer door 22 while retaining tension in the linkage 218 during the opening and closing of the outer and inner doors 22, 30. In addition, the linkage 218 revolves around each of the first, second, and third pulleys 214*a*-214*c* to provide minimal resistance and a smooth transition of the outer and inner doors 22, 30 between the open and closed positions 24, 26.

While in the closed position 26, the outer door 22 may remain spaced apart from the inner door 30 by a stopper member 238 positioned on a first end 242 of the outer door 22. The stopper member 238 provides tactile feedback for the user to indicate when the outer and inner doors 22, 30 are in the closed position 26, such that the inner door 30 is sealed with the tub 18. In addition, the stopper member 238 maintains the space 168 between the outer and inner doors 22, 30 so the inner door 30 can articulate along with the tub 18 while minimizing contact with the outer door 22. Due to the articulations of the inner door 30, the stopper member 238 may undergo a biasing force to provide the tactile feedback and absorb the movement of the inner door 30 during a laundry cycle.

Referring now to FIGS. 10-13, the outer and inner doors 22, 30, as illustrated, are further operably coupled by a latch 260 and magnets 264. The magnets 264 are disposed on an internal perimeter 268 of the inner door 30 proximate to a notch 272 defined by the inner door 30 through which the latch 260 can pass. As the tub ring 96 is typically made from a metallic material, the magnets 264 couple the inner door 30 to the tub ring 96 using a magnetic force 274. Although illustrated proximate the notch 272, the magnets 264 may be disposed along various portions of the internal perimeter 268 to secure the inner door 30 to the tub ring 96.

As depicted, the tub ring 96 includes the locking member 124 that receives the latch 260. As the outer door 22 typically remains stationary in the closed position 26, the latch 260 may be rotationally and/or hingedly movable relative to the outer door 22. Accordingly, the latch 260 secures the outer door 22 in the closed position 26, such that the outer door 22 remains stationary during operation of the laundry appliance 10. Additionally or alternatively, the locking member 124 may be positioned on the cabinet 14 to fix the outer door 22 in the closed position 26 to the general movement of the inner door 30, which is coupled to the tub 18. To detach the outer door 22 from the cabinet 14 and/or the tub ring 96, the user may apply a pulling force to the outer door 22 to disengage the latch 260 from the locking member 124. Additionally or alternatively, the user may press upon the outer door 22 to disengage the latch 260.

Figure 13:
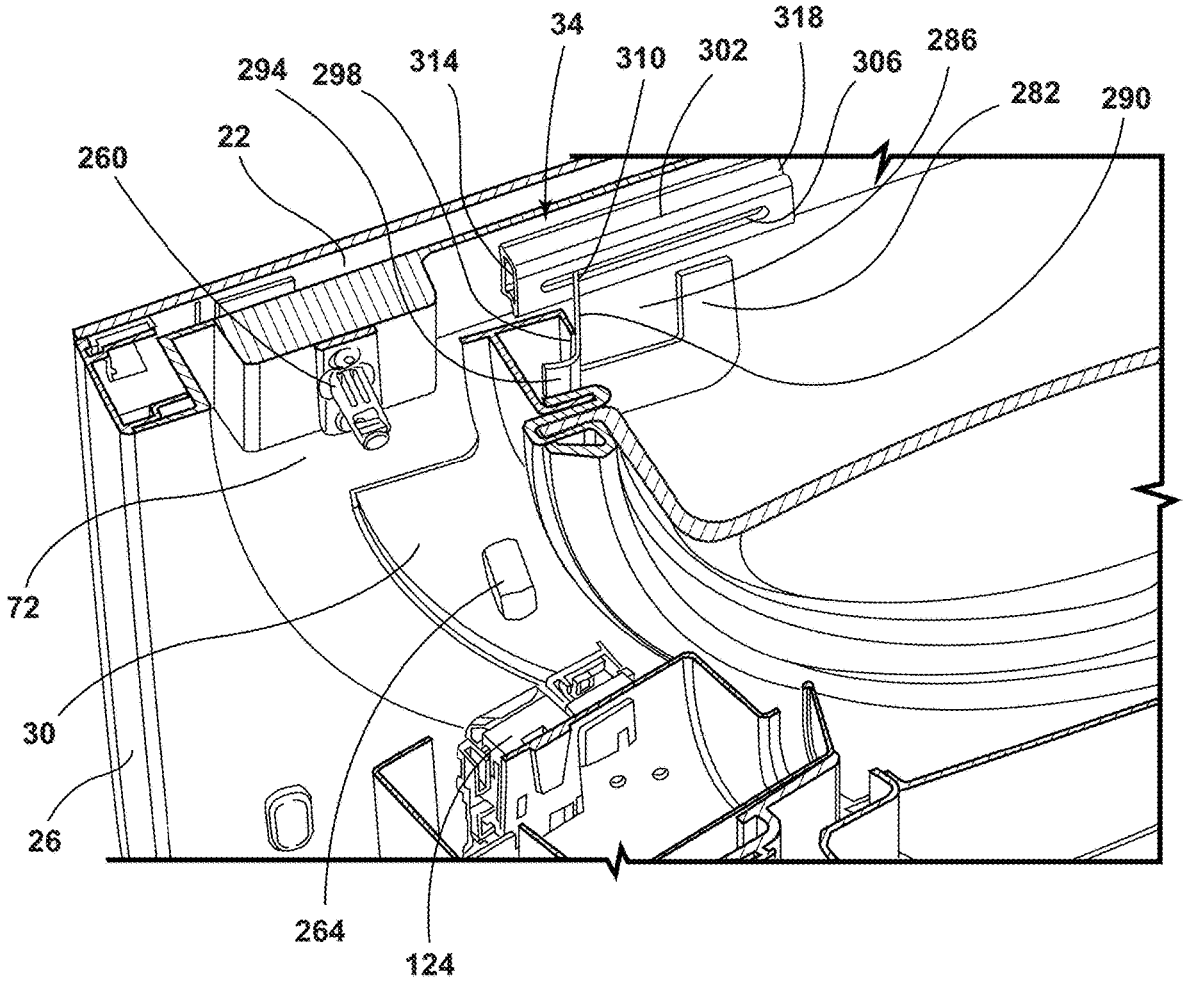
FIG. 13 is a top cross-sectional perspective view of a retention member of the coupling member of FIG. 12 and a latch of the first door.
Figure 14:
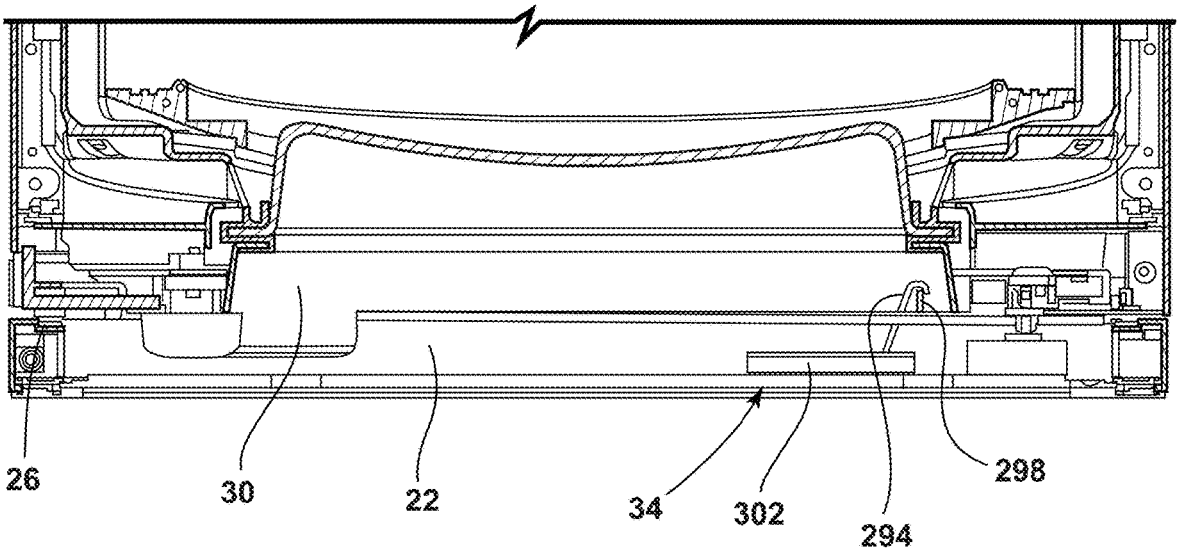
FIG. 14 is a top cross-sectional view of the appliance of FIG. 10 with the coupling member of FIG. 12.
Figure 15:
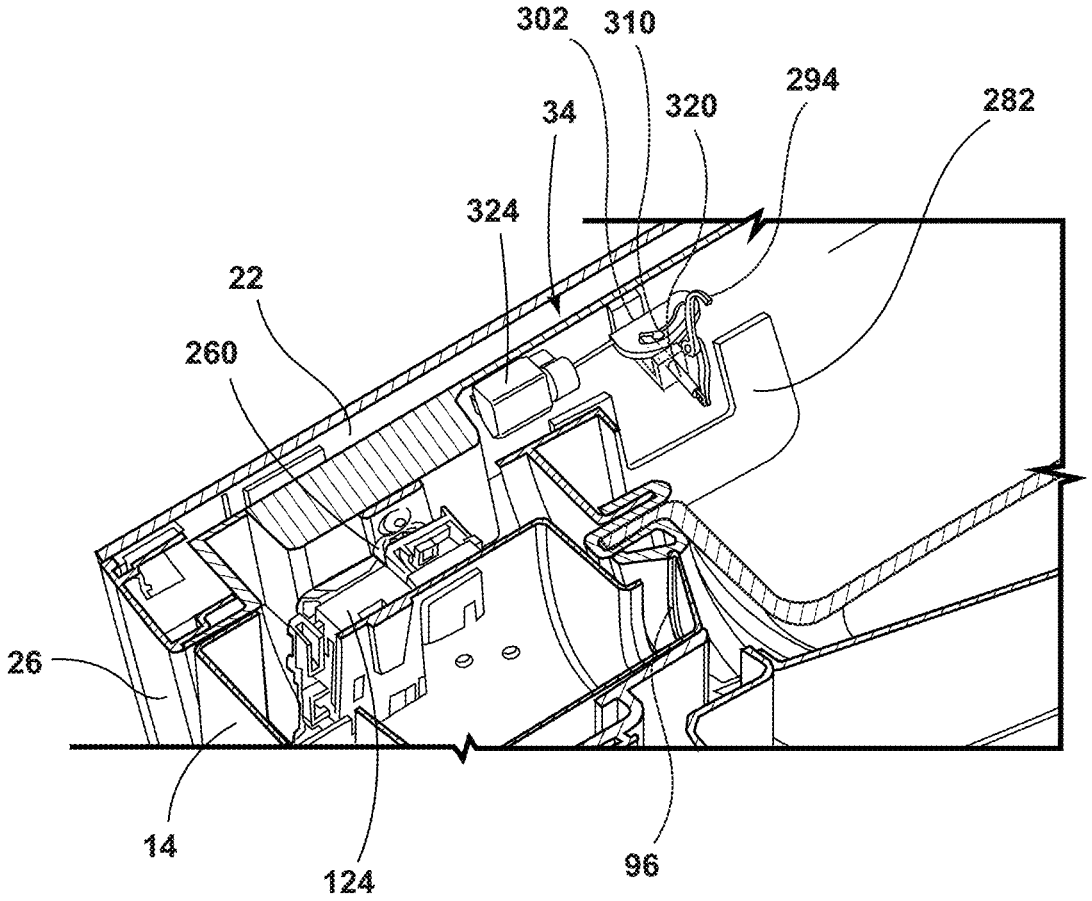
FIG. 15 is a top cross-sectional view of an aspect of a coupling member of the present disclosure.

Referring now to FIGS. 13-15, the inner door 30 defines a retention frame 282, which further defines an aperture 286 through which a retention member 290 of the coupling member 34 may extend. As the outer and inner doors 22, 30 move from the closed position 26 to the open position 24, a hook 294 of the retention member 290 catches on a lip 298 of the retention frame 282 to couple the outer and inner doors 22, 30. As the outer door 22 opens, the hook 294 pulls on the retention frame 282, and consequently, pulls the inner door 30 open. Additionally, the retention member 290 may shift within a slide member 302 when the outer and inner doors 22, 30 transition between the open and closed positions 24, 26.

The slide member 302 is coupled to the outer door 22, typically on the recessed portion 72, and defines a slot 306 through which the retention member 290 extends. The retention member 290 has a detained end 310 positioned within the slot 306 of the slide member 302 and shifts within and along the slot 306 during opening and closing of the outer and inner doors 22, 30. The detained end 310 may have an enlarged shape, typically a T-shape configuration, which may prevent the retention member 290 from shifting out of the slide member 302. Additionally or alternatively, the detained end 310 may be circular, square, or any other shape practicable for detaining the detained end 310 within the slide member 302. The slide member 302 may be hollow, such that the detained end 310 of the retention member 290 may be accessible from a first or a second end 314, 318 of the slide member 302, typically for maintenance purposes. It is also contemplated that the slide member 302 may have a flat body that defines the slot 306, described in more detail below in relation to FIGS. 15 and 16.

The hook 294 is typically unattached to the lip 298 and/or the inner door 30 while the outer and inner doors 22, 30 are in the closed position 26 or are moved toward the closed position 26. Accordingly, the inner door 30 may be generally free to move in the closed position 26 based on the movement of the tub 18 without catching, or being retained by, the retention member 290. For example, during a laundry cycle, the tub 18 can move in a general rotational motion during which the inner door 30 will move along with the tub 18, and the outer door 22 remains in a fixed position relative to the tub 18 and the inner door 30. Thus, the retention frame 282 also moves in response to the movement of the tub 18, and as the hook 294 is typically unattached in the closed position 26, the retention frame 282 and the inner door 30 are generally free to move with the tub 18. Moreover, the outer door 22 remains stationary during the laundry cycle as the retention member 290 is unattached to the retention frame 282 in the closed position 26.

Figure 16:
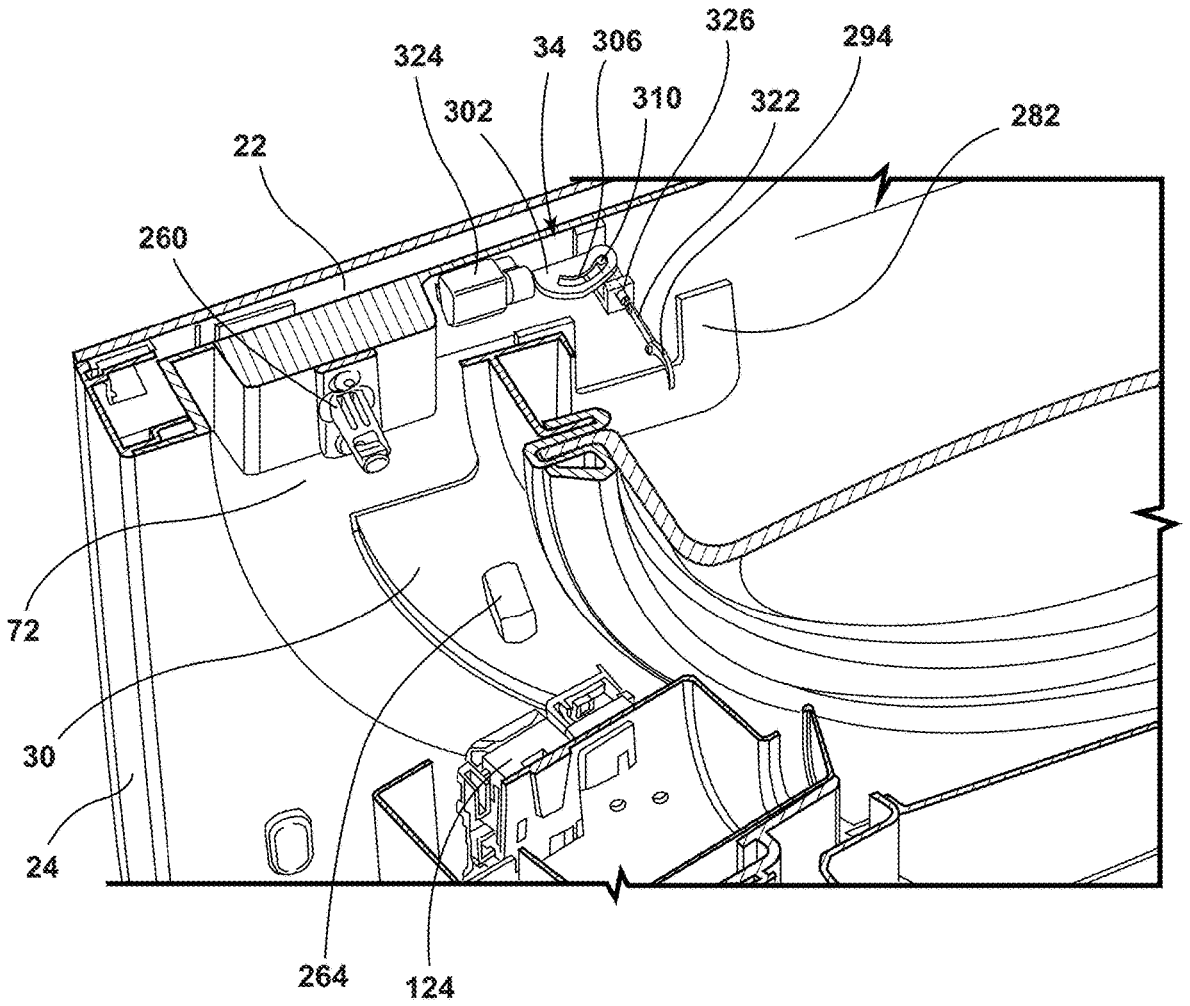
FIG. 16 is a top cross-sectional view of the coupling member of FIG. 15 coupling the first door and the second door in an open position.

Referring now to FIGS. 15 and 16, the hook 294 is illustrated as being operable between a raised position 320 and a lowered position 322. In this alternate construction, a motor 324 is coupled to the outer door 22 and the slide member 302. The motor 324 translates the slide member 302, such that the movement of the slide member 302 moves the retention member 290 and, ultimately, the hook 294. As illustrated, the slot 306 defined by the slide member 302 is generally curved, such that the movement of the detained end 310 within the slot 306 translates the retention member 290 forward and backward. The forward and backward movement of the retention member 290 ultimately translates to the upward and downward movement of the hook 294 between the raised and lowered positions 320, 322. Again, regardless of the construction, the coupling member 34 couples the inner and outer doors 30, 22 in the open position 24, such that the inner and outer doors 30, 22 operate as a single unit. Moreover, the inner door 30 can move independently of the outer door 22 regardless of the construction of the coupling member 34.

The hook 294 is coupled to the retention member 290 via a pivot connector 326 that is configured to translate the hook 294 between the raised and lowered positions 320, 322 as the retention member 290 is articulated by the slide member 302. The motor 324 is activated by the movement of the outer door 22 to move the slide member 302, which in turn translates the detained end 310 of the retention member 290 within the curved slot 306. The retention member 290, and in turn the hook 294, is pulled by the slide member 302 as a result of the curvature of the slot 306. For example, the hook 294 is in the raised position 320 when the detained end 310 is proximate to the first end 314 of the slide member 302, and the hook 294 is in the lowered position 322 when the detained end 310 is proximate to the second end 318 of the slide member 302. The detained end 310 translates from the first end 314 to the second end 318 of the slide member 302 as the inner and outer doors 30, 22 are translated from the closed position 26 to the open position 24.

Figure 17:
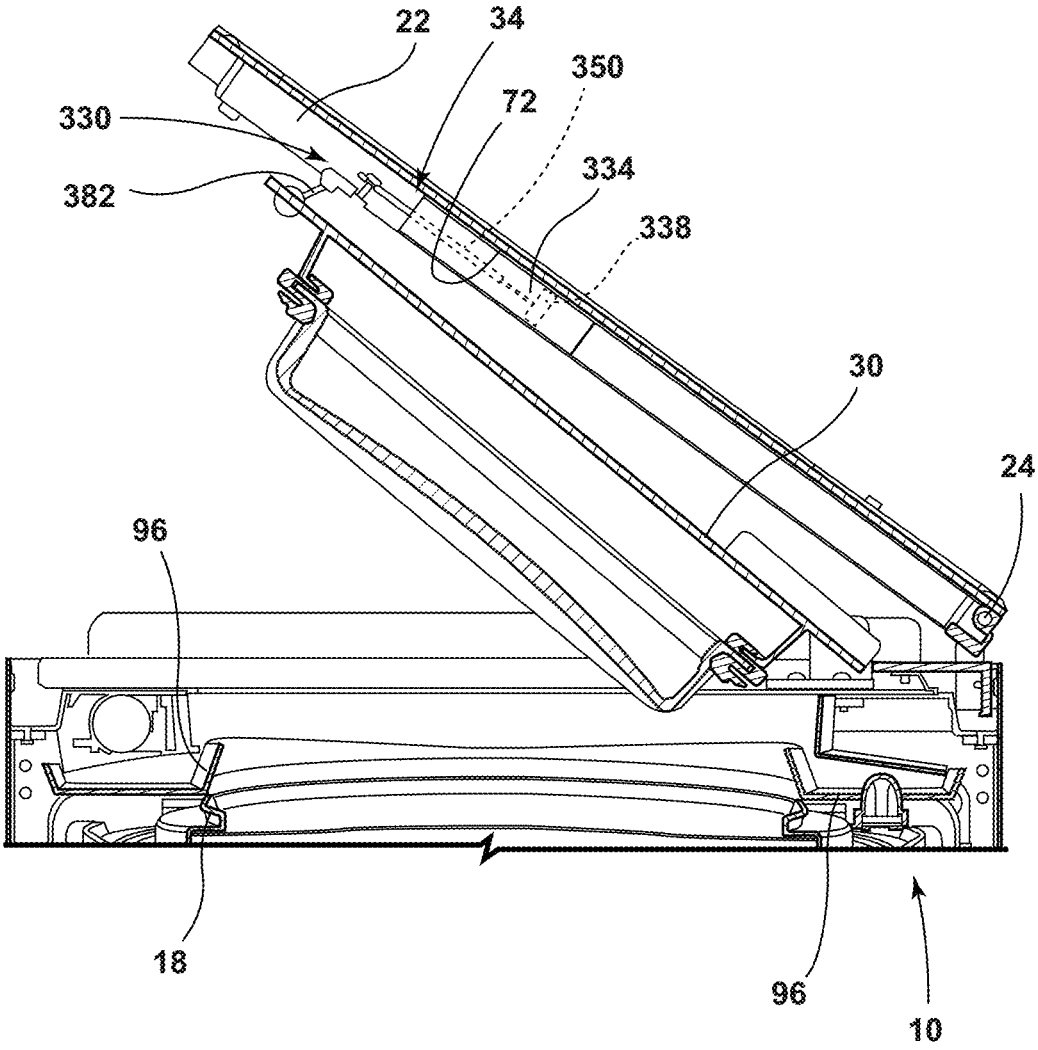
FIG. 17 is a top cross-sectional view of the appliance of FIG. 10 that incorporates an aspect of a coupling member of the present disclosure.
Figure 18:
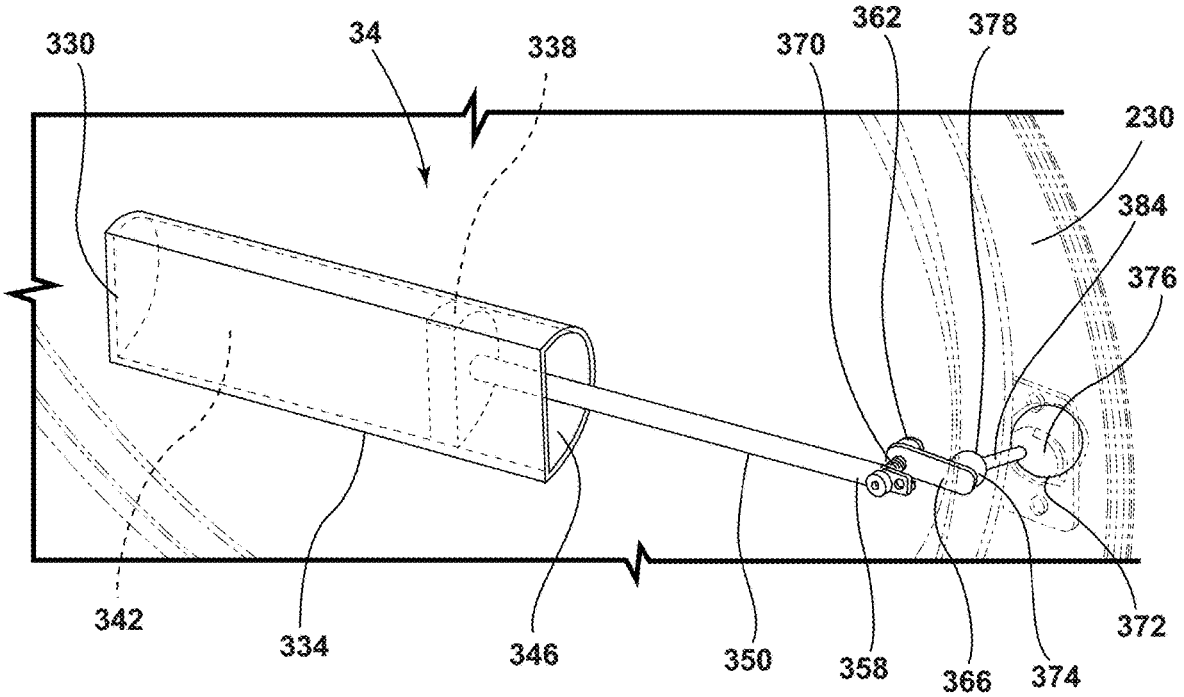
FIG. 18 is an enlarged view of the coupling member of FIG. 17 of the present disclosure.

Referring to FIGS. 17 and 18, the coupling member 34 is illustrated as a gas-spring assembly 330, typically a piston-type cylinder, coupled to the outer door 22, which can allow for controlled opening and closing of the outer and inner doors 22, 30. The gas-spring assembly 330 includes a body 334 that is generally enclosed such that a base 338 transitionally defines an enclosed portion 342 and an exposed portion 346 of the body 334. As the outer and inner doors 22, 30 enter the open position 24, the exposed portion 346 of the body 334 expands in that the base 338 moves along the body 334, which minimizes the enclosed portion 342. A rod 350 is integrally formed with and/or coupled to the base 338, such that the rod 350 and the base 338 are shifted into the body 334 of the gas-spring assembly 330 when the outer and inner doors 22, 30 are opened.

Typically, the compression of the enclosed portion 342, when the outer and inner doors 22, 30 are in the open position 24, may result in an increase in pressure within the enclosed portion 342. Thus, when the user opens or closes the outer and inner doors 22, 30 there may generally be a resistive force that may help control the rate of movement of the outer and inner doors 22, 30. Additionally or alternatively, the outer and inner doors 22, 30 may be biased outward by the gas-spring assembly 330.

Figure 19:
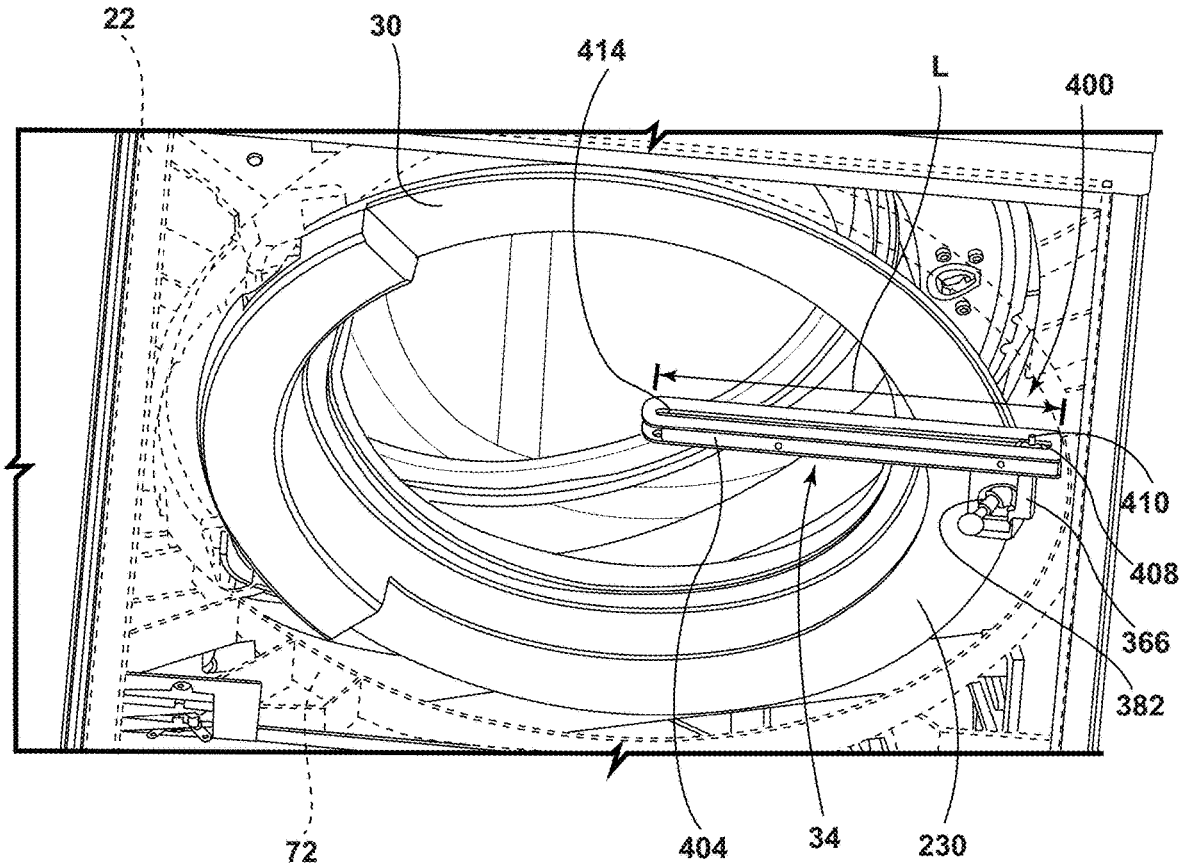
FIG. 19 is a side perspective view of a coupling member of the present disclosure coupling a first door and a second door of an appliance.

As illustrated in FIG. 18, the gas-spring assembly 330 is coupled to the recessed portion 72 of the outer door 22. However, it is also contemplated that the gas-spring assembly 330 may be coupled to the outer door 22 via brackets or other fastening members known in the art. In either configuration, the gas-spring assembly 330 is generally planar with at least the outer door 22. The gas-spring assembly 330 may be slightly offset from the inner door 30, but the gas-spring assembly 330 is at least generally aligned with the inner door 30. As depicted in FIG. 19, the rod 350 includes an attachment end 358 through which a fastener 362 couples the rod 350 to a connector 366. In addition, a spring 370 may be disposed around the fastener 362 between the rod 350 and the connector 366, such that the connector 366 may compress against the rod 350 during various articulations of the inner door 30. The spring 370 may be helical, coil, leaf, or any other spring 370 known in the art. The spring 370 may absorb the axial movement of the tub 18 and the inner door 30 with respect to the outer door 22 during the use of the laundry appliance 10. It is generally contemplated that, regardless of the construction of the coupling member 34, the inner door 30 and the outer door 22 are coupled together in the open position 24, such that the inner and outer doors 30, 22 transition between the open and closed positions 24, 26 as a single unit.

As illustrated in FIG. 18, the inner door 30 defines an inner door socket 372 and the connector 366 defines a connector socket 374 in which a first ball 376 of a ball assembly 382 may be positioned. It is generally contemplated that the inner door socket 372 and the connector socket 374 may be referred to as the first socket 372 and the second socket 374, respectively. The ball assembly 382 typically may include the first ball 376 and a second ball 378 coupled together via a post 384. It is generally contemplated that the first ball 376 is received within the inner door socket 372, and the second ball 378 is received within the connector socket 374. As depicted, the second ball 378 is generally smaller than the first ball 376. Accordingly, the connector socket 374 is also generally smaller than the inner door socket 372.

The ball assembly 382 accommodates the rotational movement of the tub 18 and, accordingly, the inner door 30. The varying size of the first and second balls 376, 378 assists in isolating the movement of the inner door 30 relative to the connector 366 and gas-spring assembly 330. For example, the second ball 378 has a smaller diameter so that small movements relative to the connector socket 374 may have a larger impact when compared to a small movement of the first ball 376 relative to the inner door socket 372. This rotational variation may help balance the rotational movement of the inner door 30 while the outer door 22 remains fixed. Thus, the inner and outer doors 30, 22 can be operably coupled in the closed position 26, while the inner door 30 can rotate independently of the outer door 22.

Figure 20:
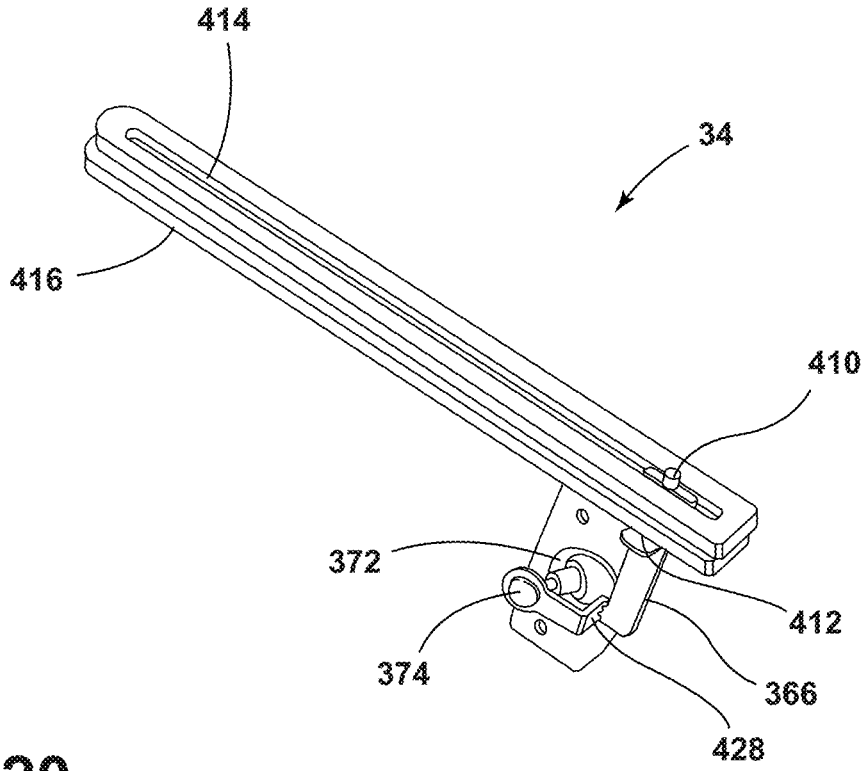
FIG. 20 is a side perspective view of the coupling member of FIG. 19.
Figure 21:
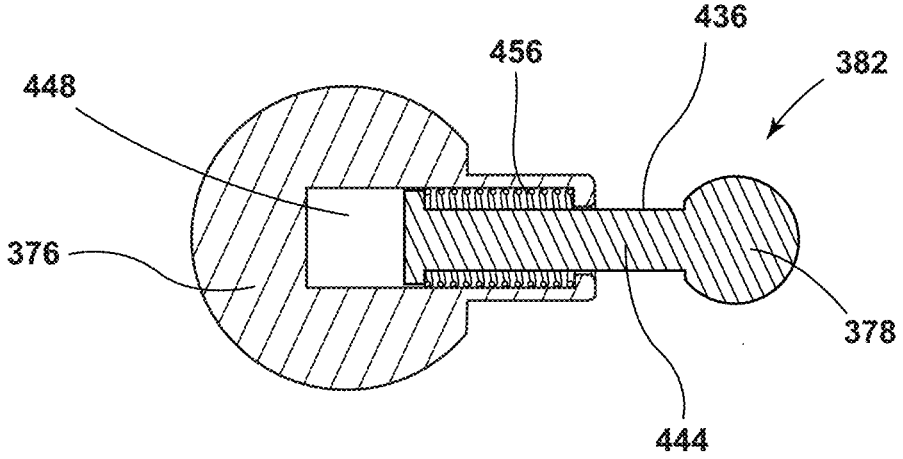
FIG. 21 is a schematic cross-sectional view of a ball-joint assembly of the coupling member of FIG. 19.

Referring now to FIGS. 19-21, the coupling member 34 may include a glide assembly 400 coupled to the recessed portion 72 of the outer door 22. The glide assembly 400, as illustrated, includes a glide track 404 that spans a length L of the outer door 22 and may generally extend past the inner door 30. A glide member 408 is positioned and may glide within the glide track 404 during the opening and closing of the outer and inner doors 22, 30. It is generally contemplated that the body 334 may also refer to the glide member 408 in that the glide member 408 serves as the body of the glide assembly 400. A top and a bottom protrusion 410, 412 of the glide member 408 extend outward from a top and a bottom groove 414, 416, respectively, defined by the glide track 404. The top and bottom protrusions 410, 412 help retain the glide member 408 within the glide track 404 during forward and rearward articulations of the inner door 30. For example, the bottom protrusion 412 may be operably coupled to the inner door 30 via the connector 366, which is depicted as a shoulder joint, and the ball assembly 382.

As illustrated in FIG. 21, the shoulder joint configuration of the connector 366 is typically flexible, such that a central portion 428 of the illustrated connector 366 can define a living hinge. Accordingly, the central portion 428 generally flexes in response to the various articulations of the inner door 30 during laundry cycles. As described above, the connector 366 includes the connector socket 374 configured to receive the second ball 378 of the ball assembly 382. As depicted in FIG. 21, the ball assembly 382 includes a compression member 436 that includes the second ball 378 and a shaft 444, which may be positioned within a void 448 defined by the first ball 376 of the ball assembly 382. Typically, the first ball 376 is larger than the compression member 436 as the first ball 376, at least partially, retains the shaft 444 of the compression member 436 as well as a resilient member 456 proximate the shaft 444. In addition, the first ball 376 is operably coupled to the inner door 30 by the inner door socket 372, as described above.

As the outer door 22 transitions from the closed position 26 (FIG. 1) to the open position 24 (FIG. 2), the glide member 408 may slide along the top and bottom grooves 414, 416 of the glide track 404. The sliding motion of the glide member 408 may, in turn, pull on the connector 366 and ball assembly 382. Accordingly, the inner door 30 may open in conjunction with the opening of the outer door 22. While in the closed position 26, and during the laundry cycle, the inner door 30 rotates as well as moves in a forward and rearward direction. In response, the first ball 376 compresses the resilient member 456, which ultimately may compress the central portion 428 of the connector 366. Typically, the central portion 428 disperses the compressive force, such that the outer door 22 remains fixed in the closed position 26.

Referring again to FIGS. 1-21, the coupling member 34 allows the inner and outer doors 30, 22 to operate as a unit when the user opens and closes the outer door 22. The coupling member 34 also generally keeps the inner and outer doors 30, 22 connected in the closed position 26 while maintaining the fixed appearance of the outer door 22. The inner door 30, via the coupling member 34, is capable of being both operably coupled to the outer door 22 and rotatably and articulatably coupled to the tub 18 in the closed position 26. Thus, a user may have a personalized, aesthetic outer door 22, while the functionality of the inner door 30 to seal the tub 18 is maintained.

The invention disclosed herein is further summarized in the following paragraphs and is further characterized by combinations of any and all of the various aspects described therein.

According to one aspect of the present disclosure, a laundry appliance includes a cabinet and a tub that is disposed within the cabinet. A first door is coupled to the cabinet and is operable between open and closed positions. A second door is operably coupled to the tub. The second door is configured to move with the tub and independently of the first door in the closed position. A coupling member is at least partially disposed on the first door. The first and second doors are operably coupled by the coupling member.

According to another aspect, a coupling member includes a plurality of pulleys and a belt that is disposed around the plurality of pulleys.

According to another aspect, a plurality of pulleys includes a first pulley, a second pulley, and a third pulley. The first pulley is coupled to the second pulley via a crossbar.

According to another aspect, first and second pulleys are coupled to a first door and a third pulley is coupled to a second door.

According to another aspect, a coupling member includes a retention member that is coupled to a first door. A hook is selectively coupled to a second door. The hook includes a detained end that is operably coupled to the retention member.

According to another aspect, a coupling member includes a body that is coupled to a first door, a connector that is operably coupled to a second door, and a ball assembly that has a first ball and a second ball.

According to another aspect, a second door defines a first socket and a connector defines a second socket. A first ball is disposed within the first socket and a second ball is disposed within the second socket.

According to another aspect of the present disclosure, a laundry appliance includes a cabinet. A tub is disposed within the cabinet. A first door is operably coupled to the cabinet. A second door is operably coupled to the tub and is selectively coupled to the first door. The second door is configured to move independently of the first door and in unison with the tub in a closed position. A coupling member is coupled to the first door and is selectively coupled to the second door. The coupling member includes a retention member that is coupled to the first door, a hook that is selectively coupled to the second door, and a detained end that is coupled to the hook and is operably coupled to the retention member.

According to another aspect, a retention member defines a slot in which a detained end is disposed.

According to another aspect, a second door includes a retention frame that defines an aperture. A hook extends through the aperture and is selectively coupled to the retention frame.

According to another aspect, a retention member is operably coupled to a hook. The retention member includes a motor that is configured to translate the hook between a raised position and a lowered position.

According to another aspect, first and second doors are operable between an open position and a closed position. A coupling member couples the first and second doors in the open position and uncouples the first and second doors in the closed position.

According to another aspect, a second door has a retention frame that has a lip. A hook of a coupling member is selectively coupled to the lip.

According to another aspect, a first magnet is disposed on a second door. A second magnet is disposed on the second door. The first and second magnets are selectively coupled to a tub in a closed position.

According to yet another aspect of the present disclosure, a laundry appliance includes a cabinet. A tub is disposed within the cabinet. A first door is operably coupled to the cabinet. A second door is operably coupled to the tub and defines an inner door socket. A coupling member is coupled to the first door and is selectively coupled to the second door. The coupling member includes a body that is coupled to the first door, a connector that is coupled to the body and has a connector socket, and a ball assembly that is operably coupled to the connector and the second door via the inner door socket and the connector socket, respectively.

According to another aspect, a coupling member further includes a rod that has a base and is operably coupled to a connector.

According to another aspect, a body of a coupling member has an enclosed portion and an exposed portion. A base of a rod is disposed and translates within the body to define the enclosed portion and the exposed portion.

According to another aspect, a spool has a first protrusion and a second protrusion. The first protrusion is operably coupled to a body and the second protrusion is operably coupled to a connector.

According to another aspect, a body includes a glide track having a top groove and a bottom groove, and wherein a spool is disposed within the glide track with first and second protrusions outwardly extending from the top and bottom grooves, respectively.

According to another aspect, a ball assembly includes a spheroid assembly that is rotatably coupled to an inner door socket and a connector socket.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:
a cabinet;
a tub disposed within the cabinet;
a first door coupled to the cabinet and operable between open and closed positions;
a second door operably coupled to the tub, wherein the second door is configured to move with the tub and independently of the first door in the closed position; and
a coupling member is at least partially disposed on the first door, wherein the first and second doors are operably coupled by the coupling member, wherein the coupling member includes a plurality of pulleys and a belt disposed around the plurality of pulleys.

2. The laundry appliance of claim 1, wherein the plurality of pulleys includes a first pulley, a second pulley, and a third pulley, and wherein the first pulley is coupled to the second pulley via a crossbar.

3. The laundry appliance of claim 2, wherein the first and second pulleys are coupled to the first door and the third pulley is coupled to the second door.

4. A laundry appliance, comprising:
a cabinet;
a tub disposed within the cabinet;
a first door operably coupled to the cabinet;
a second door operably coupled to the tub and selectively coupled to the first door, wherein the second door is configured to move independently of the first door and in unison with the tub in a closed position; and
a coupling member coupled to the first door and selectively coupled to the second door, the coupling member comprising:
a retention member coupled to the first door;
a hook selectively coupled to the second door;
a detained end coupled to the hook and operably coupled to the retention member, and
the second door includes a retention frame defining an aperture, and wherein the hook extends through the aperture and is selectively coupled to the retention frame.

5. The laundry appliance of claim 4, wherein the retention member defines a slot in which the detained end is disposed.

6. The laundry appliance of claim 4, wherein the retention member is operably coupled to the hook, and wherein the retention member includes a motor configured to translate the hook between a raised position and a lowered position.

7. The laundry appliance of claim 4, wherein the first and second doors are operable between an open position and the closed position, and wherein the coupling member couples the first and second doors in the open position and uncouples the first and second doors in the closed position.

8. The laundry appliance of claim 4, wherein the second door has a retention frame having a lip, and wherein the hook of the coupling member is selectively coupled to the lip.

9. The laundry appliance of claim 4, further comprising:
a first magnet disposed on the second door; and
a second magnet disposed on the second door, the first and second magnets selectively coupled to the tub in the closed position.

10. A laundry appliance, comprising:
a cabinet;
a tub disposed within the cabinet;
a first door operably coupled to the cabinet;
a second door operably coupled to the tub and defining an inner door socket; and
a coupling member coupled to the first door and selectively coupled to the second door, the coupling member comprising:
a body coupled to the first door;
a connector coupled to the body and having a connector socket; and
a ball assembly operably coupled to the connector and the second door via the inner door socket and the connector socket, respectively.

11. The laundry appliance of claim 10, the coupling member further comprising:
a rod having a base and operably coupled to the connector.

12. The laundry appliance of claim 11, wherein the body of the coupling member has an enclosed portion and an exposed portion, and wherein the base of the rod is disposed and translates within the body to define the enclosed portion and the exposed portion.

13. The laundry appliance of claim 10, wherein the coupling member further comprises:
a spool having a first protrusion and a second protrusion, wherein the first protrusion is operably coupled to the body and the second protrusion is operably coupled to the connector.

14. The laundry appliance of claim 13, wherein the body comprises a glide track having a top groove and a bottom groove, and wherein the spool is disposed within the glide track with the first and second protrusions outwardly extending from the top and bottom grooves, respectively.

15. The laundry appliance of claim 10, wherein the ball assembly comprises a first ball and a second ball rotatably coupled to the inner door socket and the connector socket, respectively.

* * * * *